US005588263A

United States Patent [19]

Kelly et al.

[11] Patent Number: 5,588,263

[45] Date of Patent: Dec. 31, 1996

[54] DOUBLE ADAPTOR BAR FOR SINGLE INSERTS USED IN CASTING CONCRETE

[75] Inventors: David L. Kelly, Sacramento, Calif.; Sidney E. Francies, III, San Antonio, Tex.

[73] Assignee: HEM Trading, Long Beach, Calif.

[21] Appl. No.: 309,808

[22] Filed: Sep. 21, 1994

[51] Int. Cl.[6] ..... E04G 21/14

[52] U.S. Cl. ..... 52/125.4; 52/125.5; 52/712

[58] Field of Search ..... 52/124.2, 125.2, 52/125.4, 125.5, 125.6, 712, 713, 701, 706, 707, 166, 720.1, 726.2, 732.2, 733.1, 739.1

[56] References Cited

U.S. PATENT DOCUMENTS

| | | | |
|---|---|---|---|
| 1,656,378 | 1/1928 | Lampert . | |
| 1,672,176 | 6/1928 | Schumacher et al. . | |
| 1,841,699 | 1/1932 | Bauman . | |
| 3,530,634 | 9/1970 | Adams | 52/687 |
| 4,007,572 | 2/1977 | Ilukowicz | 52/687 |
| 4,246,736 | 1/1981 | Kovar et al. | 52/712 X |
| 4,463,057 | 7/1984 | Knurr | 52/720.1 |
| 4,580,378 | 4/1986 | Kelly et al. | 52/125.5 |
| 4,793,104 | 12/1988 | Hultberg et al. | 52/121.3 |
| 4,869,042 | 9/1989 | Fricker | 52/125.4 X |
| 4,930,269 | 6/1990 | Kelly et al. | 52/125.5 |
| 5,056,289 | 10/1991 | Colen | 52/712 X |

FOREIGN PATENT DOCUMENTS

| | | | |
|---|---|---|---|
| 2633322A1 | 6/1988 | France | E04C 5/20 |
| 904766 | 8/1962 | United Kingdom . | |

OTHER PUBLICATIONS

Burke Double Lifting Inserts; Burke Catalog No. 910; Apr. 1991.

Burke Double Super–Lift T–Bar Anchor; Burke Drawing 20351; Oct. 20, 1987.

*Primary Examiner*—Creighton Smith

*Attorney, Agent, or Firm*—Limbach & Limbach L.L.P.

[57] ABSTRACT

An adaptor bar is disclosed for removably coupling in fixed relation a pair of single anchor inserts used in casting concrete, thereby forming a double anchor insert. The anchor inserts are used as permanently installed lifting points in the construction of tilt-up concrete walls and the like. The adaptor bar includes T-shaped cutouts in each end which cooperate with reliefs in an elongated anchor member of a single anchor insert to allow the adaptor bar to releasably engage an elongated anchor member at each end. The inventive adaptor bar provides for an inexpensive double anchor and allows the user to only stock single anchors without the need to have a separate inventory of double anchors as well.

10 Claims, 1 Drawing Sheet

DOUBLE ADAPTOR BAR FOR SINGLE INSERTS USED IN CASTING CONCRETE

BACKGROUND OF THE INVENTION

1. Field of the Invention

The present invention relates to concrete anchors used for constructing tilt-up concrete walls which are cast in a horizontal position, and in particular to an adaptor bar for reversibly converting two single anchors into a double anchor.

2. Discussion of the Prior Art

Many buildings are constructed utilizing concrete wall slabs which are cast on sight in a horizontal position. The slabs are then tilted up to a vertical position to form a building wall or the like. Typically, anchors are imbedded in the walls during the casting process for use as lifting points in raising such tilt-up walls. U.S. Pat. No. 4,580,378 entitled "Anchor Assembly For Tilt-Up Wall Section" discloses the construction and method of use of such concrete anchors.

It is often desirable to use pairs of uniformly spaced anchors when hoisting concrete walls. Previously, "double" anchors have been constructed by welding a steel rod between two "single" anchors to permanently attach them together with a fixed spacing. This arrangement, however, is costly to fabricate. It requires both double and single anchors be inventoried. Because different wall thicknesses require different height anchors, a variety of heights of both double and single anchors must also be stocked. If a double anchor having two different heights is desired, it must be custom manufactured. Once a double anchor is fabricated, it is difficult to separate it back into two singles if needed. This arrangement requires exact planning prior to setting anchors, and or an extensive inventory of different types of anchors. Because of the inflexibility of this system, an unexpected shortage of a particular type of anchor can lead to costly delays on the construction sight.

SUMMARY OF THE INVENTION

The present invention solves the above-mentioned problems by providing an inexpensive, removable adaptor bar that can be utilized to interconnect a pair of single cement anchors in spaced relation.

In the preferred embodiment of the present invention, an elongated adaptor bar is provided with a T-shaped keyed cutout at both its ends. A narrow portion of each cutout can be slid past a pair of grooves in a single anchor. The cutouts are proportioned to receive an anchor once the narrow portion is slid past the grooves. The adaptor bar can then be slid downward over the two anchors, thereby captivating the anchors within the cutouts and maintaining them in spaced relation. In the preferred embodiment, the mating grooves utilized to receive the narrow portion of the cutout are existing grooves that can also be used to secure the anchor with wire before cement is poured around it.

The adaptor bar of the present invention allows double anchors to be quickly created from single anchors as required on the construction sight without expensive welding. This eliminates the need to inventory double anchors. If more double anchors are created than are needed, they are easily disassembled for use as single anchors.

Different height anchors can be coupled on sight using the present invention, such as when a double anchor straddles two wall sections of different thicknesses. If desired, more than two single anchors can be linked together. For instance, two adaptor bars can be utilized to link three single anchors to form a triple anchor. The present invention reduces costs and inventories, and allows greater flexibility on the construction sight.

DETAILED DESCRIPTION OF THE PREFERRED EMBODIMENT

Figure 2:
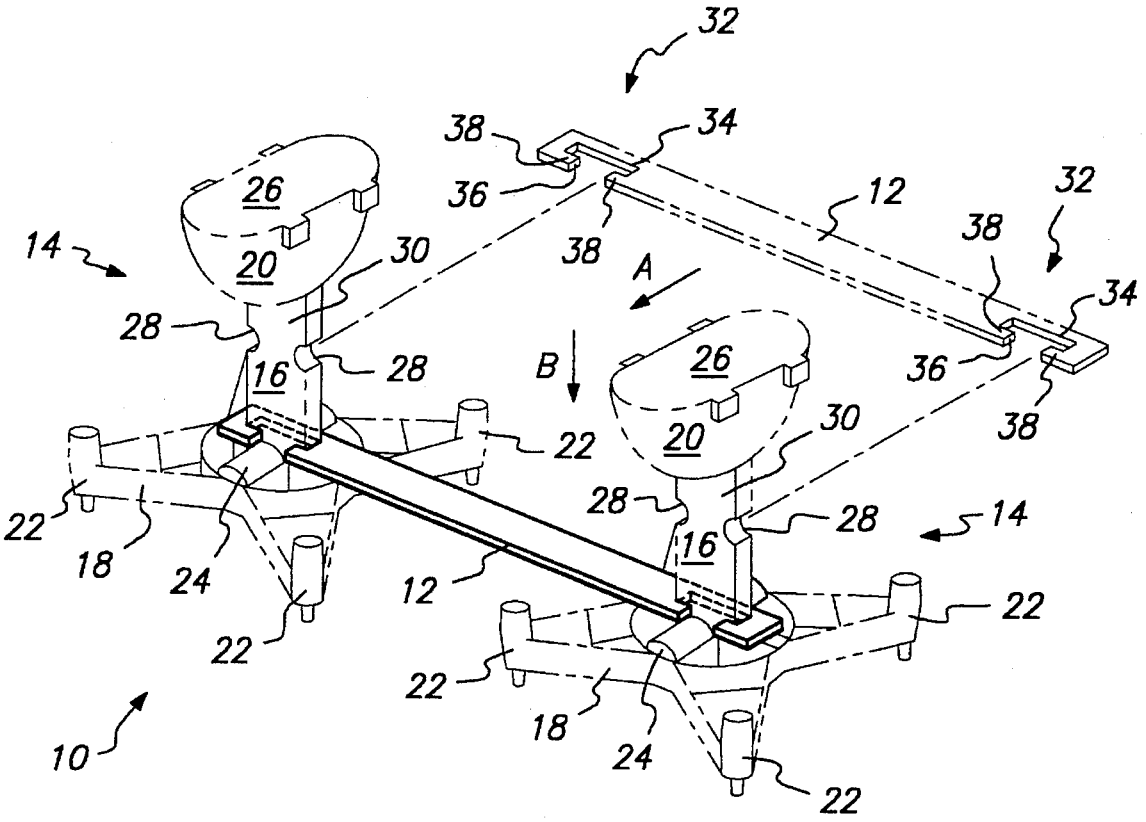
FIG. 2 is an exploded perspective view showing the adaptor bar of the present invention, separately in phantom lines, and also in place linking a pair of single anchors.

Referring to FIG. 2, a double anchor 10 is shown, which includes an adaptor bar 12 releasably connecting a pair of single anchors 14 in fixed relation. Each single anchor 14 includes a vertically oriented, elongated anchor member 16, a base member 18, and a recess former 20. Base member 18 includes four legs 22 which support the anchor on the bottom of a cement form (not shown). Anchor pin 24 is received through the lower end of elongated anchor member 16 and is used to releasably secure elongated anchor member 16 to base member 18. Recess former 20 is removably attached to the upper end of elongated anchor member 16, and includes a removable lid section 26. Reliefs 28 are formed on opposite sides of a middle portion of elongated anchor member 16, thereby creating a narrowed cross-section 30° This type of single anchor is shown in U.S. Pat. No. 4,580,378.

Figure 1:
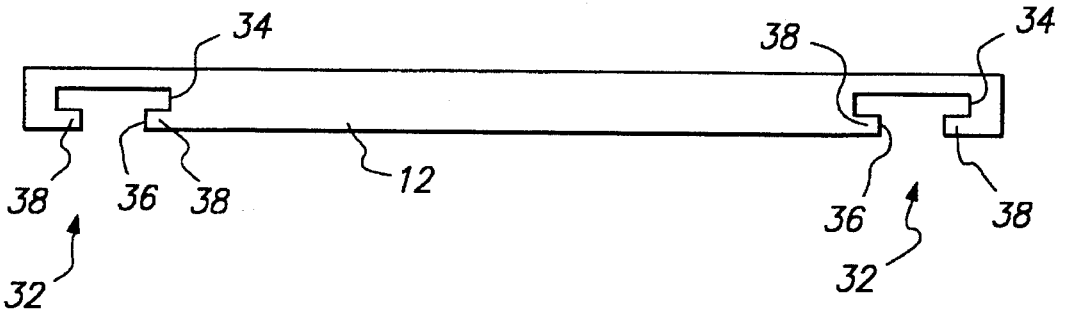
FIG. 1 is a plan view showing the adaptor bar of the present invention.

Referring to FIG. 1, the preferred embodiment of the adaptor bar 12 is shown. A T-shaped cutout 32 is formed through each end of adaptor bar 12. Each T-shaped cutout 32 is partially composed of a rectangular cutout 34 which has a complementary size and shape of a full cross-section of elongated anchor member 16. The remainder of T-shaped cutout 32 is composed of a narrowed connecting passage 36, which extends the middle portion of rectangular cutout 34 through a lateral edge of elongated member 12, leaving protrusions 38 on either side. The length of narrowed connecting passage 36 (in other words the distance between a pair of protrusions 38), is complementary to the length of the narrowed cross-section 30 of elongated anchor member 16.

Referring again to FIG. 2, the use of adaptor bar 12 will now be described. Single anchors 14 are arranged side by side and spaced apart a distance approximately equal to the distance between T-shaped cutouts 32 on adaptor bar 12, as shown. Adaptor bar 12 is moved in the direction of arrow A toward single anchors 14 until both pairs of protrusions 38 pass through their respective pairs of reliefs 28 in elongated anchor members 16. Once each narrowed connecting passage 36 of adaptor bar 12 is past its respective narrowed cross-section 30 of elongated anchor member 16, adaptor bar 12 may be lowered in the direction of arrow B, allowing each rectangular cutout 34 to slide along its respective elongated anchor member 16 until each end of adaptor bar 12 rests on its respective anchor pin 24. In this lowered position, shown by solid lines in FIG. 2, each end of adaptor bar 12 secures a single anchor 14 by retaining the respective elongated anchor member 16 within rectangular cutout 34 with a pair of protrusions 38, thus removably forming a double anchor 10. Alternatively, adaptor bar 12 can be attached to single anchors 14 without using reliefs 28 and narrowed connecting passage 36. Instead, recess formers 20 can be removed from elongated anchor members 16, each end of adaptor bar 12 can be slid over the top of an elongated anchor member 16 and into position resting on anchor pins 24, and then recess formers 20 can be reattached to the top portions of the elongated anchor members 16.

In the preferred embodiment, the single anchors 14 are spaced apart twelve inches on center by the adaptor bar 12. Preferably, the adaptor bar 12 is made of steel, but alternatively other suitable materials could be used. Reliefs 28 are existing semi-circular notches that are used for securing the anchors to reinforcement bar (Re-bar) or the like with wire or string before the cement is poured. After adaptor bar 12 is installed, reliefs 28 remain available for their original purpose. Taking advantage of these existing features means that no re-design or re-tooling is required to fabricate new single anchors 14, and old anchors can still be used with the present invention.

As mentioned above, elongated anchor members 16 are removable from both the base member 18 and recess former 20. Different length elongated anchor members 16 can be used to form walls of different thicknesses, and adaptor bar 12 can be used with any of these lengths. The present invention also allows a pair of single anchors 14 having different lengths to be easily coupled, if desired, such as when a double anchor straddles a change in wall thickness.

Double anchor 10 is used in the same way single anchors 14 are used. That is, once the single anchors 14 are connected with adaptor bar 12, the double anchor 10 is placed in the desired location in a form with the four legs 22 of each base member 18 resting on the bottom of the form, which will define one side of the cement wall. Double anchor 10 can be secured in place as described above using reliefs 28. Cement is then poured into the form covering double anchor 10 up to a level even with or just covering lid sections 26. Once the cement has cured, any cement covering lid sections 26 is chipped away and lid sections 26 are removed. Recess formers 20 are also removed, leaving behind a recess in the cement which exposes the upper ends of elongated anchor members 16. The cement wall can then be hoisted from the horizontal position into a vertical position by attaching hoisting connectors (not shown) through holes in the exposed ends (not shown) of elongated anchor members 16. The entire double anchor 10, with the exception of the removed lid sections 26 and recess formers 20, remains permanently embedded in the cement wall. A more detailed description of single anchors 14 and their use in hoisting cement walls can be found in U.S. Pat. No. 4,580,378.

While the present invention is disclosed by reference to the example and preferred embodiment detailed above, it is to be understood that this embodiment is intended in an illustrative rather than limiting sense, as it is contemplated that modifications will readily occur to those skilled in the art, which modifications will be within the spirit of the invention and the scope of the appended claims.

What is claimed is:

1. An anchor assembly interconnecting two anchors provided for embedment in a concrete tilt-up wall section, comprising:

at least two anchors, each having a body with whole and narrowed cross-sections, and an elongated adaptor bar including first and second cutouts, each cutout being complementary in shape to the whole cross-section of the anchors and having a narrowed connecting passage extending the cutout through an adjacent edge of the elongated adaptor bar, each narrowed connecting passage having a width corresponding to the narrowed cross-section of the anchors to allow the narrowed cross-section to pass therethrough into the cutout, the cutout longitudinally movable along the anchor to the whole cross-section for securely engaging it within the cutout, thereby allowing the anchor to be retained at each end of the elongated adaptor bar for releasable interconnection in a spaced relationship.

2. An anchor assembly according to claim 1 wherein the cutouts and the narrowed connecting passages are rectangularly shaped and together form a T-shaped aperture through each end of the elongated adaptor bar.

3. An anchor assembly according to claim 2 wherein the cutouts have longitudinal axes parallel to a longitudinal axis of the adaptor bar and wherein the narrowed connecting passages extend laterally from the longitudinal axis of the cutouts.

4. A double anchor assembly for use in raising a tilt-up wall section comprising:

a pair of single anchor assemblies, each single anchor assembly further comprising:

an elongated anchor member having a first cross-section and a longitudinally spaced second cross-section, the first cross-section being smaller than the second cross-section;

base means for supporting the elongated anchor member in a generally vertical position; and an elongated adaptor bar having two ends, each end including a cutout complementary in shape to the second cross-sections, each cutout having a connecting passage extending the cutout through an adjacent edge of the elongated adaptor bar, each connecting passage having a width corresponding to the smaller first cross-section to allow the first cross-section to be slid through the connecting passage into the cutout so that the elongated adaptor bar may be slid longitudinally along the elongated anchor means from the first cross-section to the second cross-section to securely engage the second cross-section inside the cutout, thereby enabling the pair of single anchor assemblies to be removably interconnected by the elongated adaptor bar for locking the single anchor assemblies in a spaced relationship.

5. A double anchor assembly according to claim 4 wherein the smaller first cross-section is located vertically above the second cross-section on the elongated anchor member.

6. A double anchor assembly according to claim 4 wherein the smaller first cross-section is formed by a pair of semi-circular reliefs formed in opposite sides of the elongated member.

7. A double anchor assembly according to claim 6 wherein the pair of semi-circular reliefs can also be used to secure an anchor assembly with wire before cement is poured around it.

8. A double anchor assembly according to claim 4 wherein at least one of the elongated anchor members is removable from the base means and is replaceable with an anchor member of a different length.

9. A double anchor assembly according to claim 4 wherein each single anchor assembly further comprises a recess forming means disposed over an upper end of the anchor member for forming a recess in a wall section which exposes the upper end of the anchor member.

10. An improved anchor assembly for embedment in concrete tilt-up wall sections, said assembly comprising:

a pair of inserts having elongate body portions; and, an adaptor bar having cut-outs formed therein in spaced relationship, said cut-outs being complemental with and slidably received over the body portions of the inserts to releasably maintain the inserts in spaced relationship.

* * * * *